US006355119B1

(12) United States Patent
Peters et al.

(10) Patent No.: US 6,355,119 B1
(45) Date of Patent: Mar. 12, 2002

(54) HEAT TREATMENT METHOD FOR PRODUCING BOUNDARY-LAYER HARDENED LONG PRODUCTS AND FLAT PRODUCTS OF UNALLOYED OR LOW-ALLOY STEEL

(75) Inventors: Andreas Peters, Düsseldorf; Meinert Meyer, Erkrath, both of (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/566,206

(22) Filed: May 5, 2000

(30) Foreign Application Priority Data

May 7, 1999 (DE) ..... 199 21 286

(51) Int. Cl.[7] ..... C22C 38/00; C21D 8/00; C21D 8/08

(52) U.S. Cl. ..... 148/664; 148/644; 148/654; 148/662; 148/661; 148/902; 148/320

(58) Field of Search ..... 148/644, 654, 148/662, 661, 664, 902, 320

(56) References Cited

U.S. PATENT DOCUMENTS 4,180,418 A * 12/1979 Paulitsch et al. ..... 148/599

FOREIGN PATENT DOCUMENTS

DE 2916218 * 10/1980 ..... 148/902

* cited by examiner

*Primary Examiner*—Deborah Yee
(74) *Attorney, Agent, or Firm*—Friedrich Kueffner

(57) ABSTRACT

In a heat treatment method for producing boundary layer-hardened long products and flat products of unalloyed or low-alloy steel, the workpiece is cooled for producing a martensitic grain within a boundary layer of the workpiece by repeating several sequential cooling process steps. Each sequential cooling process step has a cooling phase, in which the workpiece is cooled to a temperature below a martensite starting temperature for martensitic conversion of only a portion of the boundary layer of the workpiece, and a temporal stress-relief phase for relieving stress within already formed martensitic grain areas and already formed martensite/austenite boundary areas. Subsequently, the workpiece is cooled at a cooling rate below a lower critical cooling rate for cooling the workpiece core.

8 Claims, 9 Drawing Sheets

WATER COOLING DEVICE FOR RIBBED CONCRETE STEEL WITH COMPENSATION ZONES
CK22 ROUND D= 40.0 mm, SPEED V= 3.70 m/s

COOLING ZONE : 1 2 3 4 5 6 7 8 9
LENGHT [m] :3.0 4.0 2.5 2.5 5.0 2.5 8.0 3.5 50.0
[W/m*m/k]: 11 60000 11 60000 11 60000 11 60000 11 60000 11
1=SURFACE
2=CORE
3=SECTION
TEMPERATURE / C°
1100
1000
900
800
700
600
500
400
300
200
100
0
Ms
1
2
3
0 1 2 3 4 5 6 7 8 9 10 11 12 13 14 15 16 17 18 19 20 21 22
COOLING TIME / s
WATER COOLING DEVICE FOR RIBBED CONCRETE STEEL WITH COMPENSATION ZONES
CK22 ROUND D= 40.0 mm, SPEED V= 3.70 m/s

HEAT TREATMENT METHOD FOR PRODUCING BOUNDARY-LAYER HARDENED LONG PRODUCTS AND FLAT PRODUCTS OF UNALLOYED OR LOW-ALLOY STEEL

BACKGROUND OF THE INVENTION

1. Field of the Invention

The invention relates to a heat treatment method for producing boundary layer-hardened long products and flat products of unalloyed or low-alloy steels, comprising the following steps: a first cooling process for the workpiece for producing a martensitic grain (microstructure) in the boundary layer of the workpiece as well as a second cooling process for the workpiece with a cooling rate below the lower critical cooling rate for cooling the workpiece core. In this context, the lower critical cooling rate is that cooling rate which is just great enough to form 1% martensite, i.e., the workpiece core is cooled so slowly that a ferritic-pearlitic grain is formed and not a martensitic grain.

2. Description of the Related Art

In a known method for producing boundary layer-hardened and self-annealing long products (wire, bar stock, profiled semi-finished and finished products etc.), a hardened microstructure is produced in the boundary layer of the workpiece, usually coming from the austenite temperature, in a suitable cooling device by a single quenching process (in general, by water cooling) causing the temperature to drop below the martensite starting temperature Ms. Subsequently, after stopping the cooling process, self-annealing takes place as a result of the residual heat in the interior of the long product. This method is usually employed directly after the workpiece leaves the rolling heat. However, in principle, it can also be used after an auxiliary heat treatment performed after rolling (for example, normalizing). The steels used in this method are, in general, low-alloy construction steals with a carbon content between 0.03 and 0.25%, a manganese content of 0.3 to 1.6%, and different amounts of other alloy components. For example, the quenching of reinforcement steels for steel construction in a cooling device is known. After producing a predetermined depth of converted martensitic grain (microstructure) in the boundary layer of the long product, a self-annealing step follows because of the residual heat in the interior of the workpiece. Depending on the material analysis and the depth of the hardened boundary layer, this treatment results in a certain combination of strength and tenacity properties (ductility).

SUMMARY OF THE INVENTION

It is an object of the present invention to provide a heat treatment for producing boundary layer-hardened long products and flat products which, in comparison to the workpieces produced according to the known method, have improved tenacity properties while their strength properties are maintained.

In accordance with the present invention, this is achieved in that the first cooling process is performed in several repeating steps, wherein each process step is comprised of cooling to a temperature below the martensite starting temperature for martensitic conversion of only a portion of the workpiece boundary layer and a subsequent temporal stress-relief phase for the already formed martensitic grain areas and/or the martensite/austenite boundary areas.

According to the suggested method, the first cooling process for converting (transforming) austenite to martensite is performed in several repeating steps wherein each process step is comprised of a cooling phase for cooling to a temperature below the martensite starting temperature for the purpose of martensitic conversion of only a respective portion of the workpiece boundary layer and a subsequent temporal stress-relief phase of the already formed martensitic grain areas and/or the martensite/austenite boundary areas.

The individual steps are repeated several times until the grain (microstructure) within the desired or predetermined depth of the boundary layer is completely converted to martensite. The improved mechanical properties obtained by the heat treatment according to the method of the invention are the result of the course of the martensite formation that is modified in comparison to the known method. By dividing the cooling process into multiple process steps with pauses in between the individual process steps, a hardened microstructure is produced that has a reduced number of microfissures and thus has a higher deformability under mechanical load (cold forming), which is noticeable, inter alia, by increased breaking elongation values observed in tensile tests.

The basic principles for understanding the invention reside in the characteristic of the martensitic conversion. When an iron alloy is heated to temperatures above $A_{c3}$ (the temperature at which the conversion of ferrites into austenite ends in heating) and then quenched with a sufficiently high cooling rate, the austenite grain will convert to a martensite structure. The special feature of the martensite conversion, in comparison to the diffusion-controlled transformation mechanisms, is that it is athermal. This means that the continuation of the transformation to martensite is not realized by maintaining a certain temperature, but it takes place in a cascade-like manner only upon further cooling. In contrast to the diffusion-controlled transformation, an isothermal holding period does not result in an increase of the proportion of martensite in the total grain structure. The size of the growing martensite crystals is limited by the former austenite grain boundaries. The transformation of the martensite itself takes place in two steps according to a model which is presently widely accepted: a lattice-transforming deformation step from a face-centered cubic (f.c.c.) to a body-centered cubic (b.c.c.) lattice and a lattice-maintaining adaptation/adjustment of the freshly formed martensite. The transformation of the lattice from face-centered cubic (f.c.c.) to body-centered cubic (b.c.c.) and the adaptation of the freshly formed martensite result mandatorily also in a deformation of the austenite because the martensite transformation is, on the one hand, accompanied by a volume increase of approximately 3% and, on the other hand, two principally different lattice types, i.e., body-centered cubic and face-centered cubic, contact one another at the phase boundary (compare FIG. 8). When in this context material separations at the martensite/austenite phase boundary, resulting from be unavoidable adjusting stress, are to be prevented, the austenite must be able to compensate the occurring deformations by gliding dislocation or twin accommodation. In this context, only the residual austenitic grain is concerned because the yield stress of the martensite is much greater than that of the austenite.

In general, this adaptation deformation does not occur without material separations so that technical steels, as has been proven, in the martensite phase have a greater or smaller number of microfissures after quenching. These microfissures by themselves reduce the tenacity as well as the ductility of the material because upon mechanical loading (for example, in tensile tests) these fissures are the seeds for further material separation and thus induce the general failure of the material. On the other hand, a reduction of the number of microfissures overall has a positive effect on the tenacity and the ductility of the material which, in turn, is exhibited by higher values for the breakage elongation in tensile tests.

With respect to the reduction of microfissures, the present invention suggests a heat treatment method in which the martensite transformation is not carried out by a single quenching process but is performed in a stepwise manner including short stress-relief phases between the individual transformation phases. For this purpose, the workpiece is only cooled for short periods of time to the martensite phase, and, subsequently, a temperature compensation takes place, followed by another quenching process to temperatures below the martensite starting temperature.

The compensation of the temperature is performed by self-annealing of the martensitic grain areas, formed by the corresponding cooling phase, to temperatures below $A_1$ as a result of the residual heat in the workpiece. This goes hand in hand with a relief of lattice stress. Furthermore, it is suggested that during the stress-relief phase of the individual cooling process steps, the workpiece is again heated to the austenite temperature for a partial reconversion of the already formed martensite into austenite. This has the effect that, in addition to the accordingly resulting further lattice refining, considerably fewer microfissures result during the martensitic transformation.

With the suggested method two effects are achieved: on the one hand, the size of the simultaneously transforming areas is smaller. Accordingly, an overall reduced adaptation stress results at the austenite/martensite phase boundary, and this reduces the risk of microfissure formation. On the other hand, the austenite surrounding the martensite is able to reduce adaptation stresses because of the recovery processes (mainly by gliding dislocation) occurring during the stress-relief phases. This counteracts the surpassing of the cleavage fracture stress of the f.c.c.-b.c.c. phase boundary, which may occur also by temporal overlap of the stress fields of several neighboring phase boundaries.

The suggested heat treatment can be performed directly after a rolling process of the workpiece. However, it is also possible to perform the heat treatment method according to the invention directly after a previously performed different type of (auxiliary) heat treatment, for example, normalizing.

DESCRIPTION OF THE PREFERRED EMBODIMENTS

Figure 1:
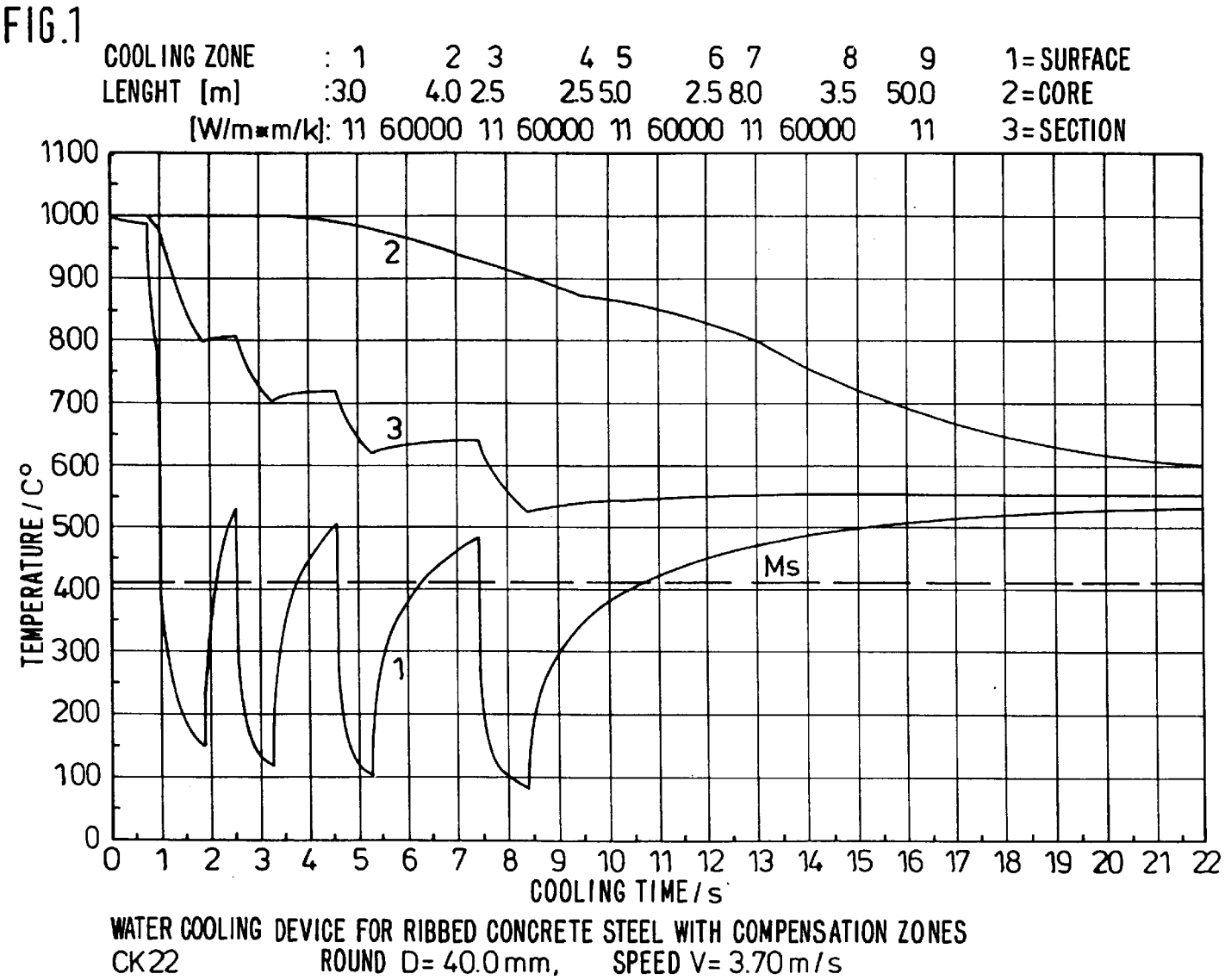
FIG. 1 shows temperature-time-curves of a ribbed concrete steel (having a total diameter of 40 mm) with boundary layers hardened by the method according to the invention.

FIG. 1 shows the temperature-time-curves of a ribbed concrete steel having a total diameter of 40 mm and having boundary layers hardened according to the present invention. The temperature curves for the surface (1) and the core (2) of the long product as well as the section (3) are represented. The workpiece passes through a cooling device which is comprised of several cooling zones with different lengths. The cooling medium is water. The workpiece is quenched (which is indicated by high or low $\alpha$-values) in the cooling zones 2, 4, 6, and 8 to a temperature below the martensite starting temperature. This martensite starting temperature is, however, above the martensite finish temperature. In the cooling zones 1, 3, 5, 7, and 9 the temporal stress-relief phases are carried out subsequently, here by means of self-annealing. In the concrete example, the workpiece, coming from a temperature of approximately 1,000° C., is quenched in the cooling zone 2 for a short period of time (cooling phase) to a temperature below the martensite starting temperature. The martensite starting temperature depends on the composition of the steel, and for the steel used in the example it is approximately 410° C. In the cooling zone downstream, the workpiece is subjected to a stress-relief phase during which the areas already transformed to martensite are self-annealed by the residual heat present within the workpiece. Moreover, the austenite surrounding the martensite has the possibility to reduce the adaptation stress.

This partial cooling process step, i.e., quenching (cooling phase) and self-annealing (stress-relief phase) with reduction of the adaptation stresses between martensite and austenite, is repeated several times. Accordingly, the still present austenitic grain areas in the boundary layer of the long product will also be transformed into martensite. FIG. 1 illustrates that only in the boundary layer hardening and annealing take place while the core of the workpiece cools slowly.

Figure 2:
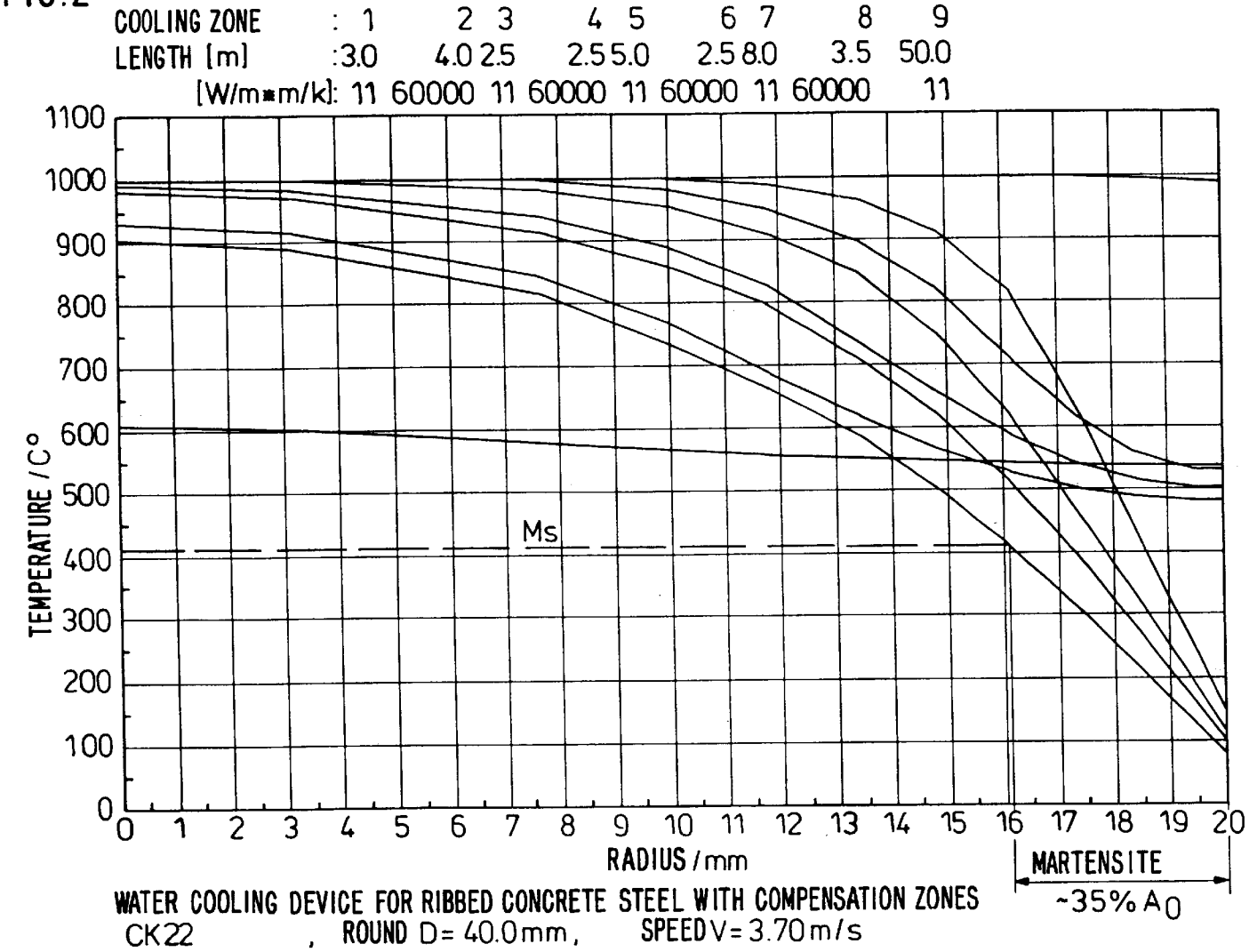
FIG. 2 shows the temperature distribution across the diameter of the ribbed concrete steel according to FIG. 1.

With the aid of FIG. 2 it is shown that only in the cooling zones 2, 4, 6, and 8 martensitic grain transformation occurs. After completion of four partial cooling process steps, 30% of the initial cross-section of the long product is converted to martensite in this example. After completion of the first cooling process comprised of the sequential cooling phases and stress-relief phases, a second cooling process follows having a cooling rate which is below the lower critical cooling rate. This second cooling process causes the still austenitic microstructure of the core to transform to a ferritic-pearlitic structure.

Figure 3:
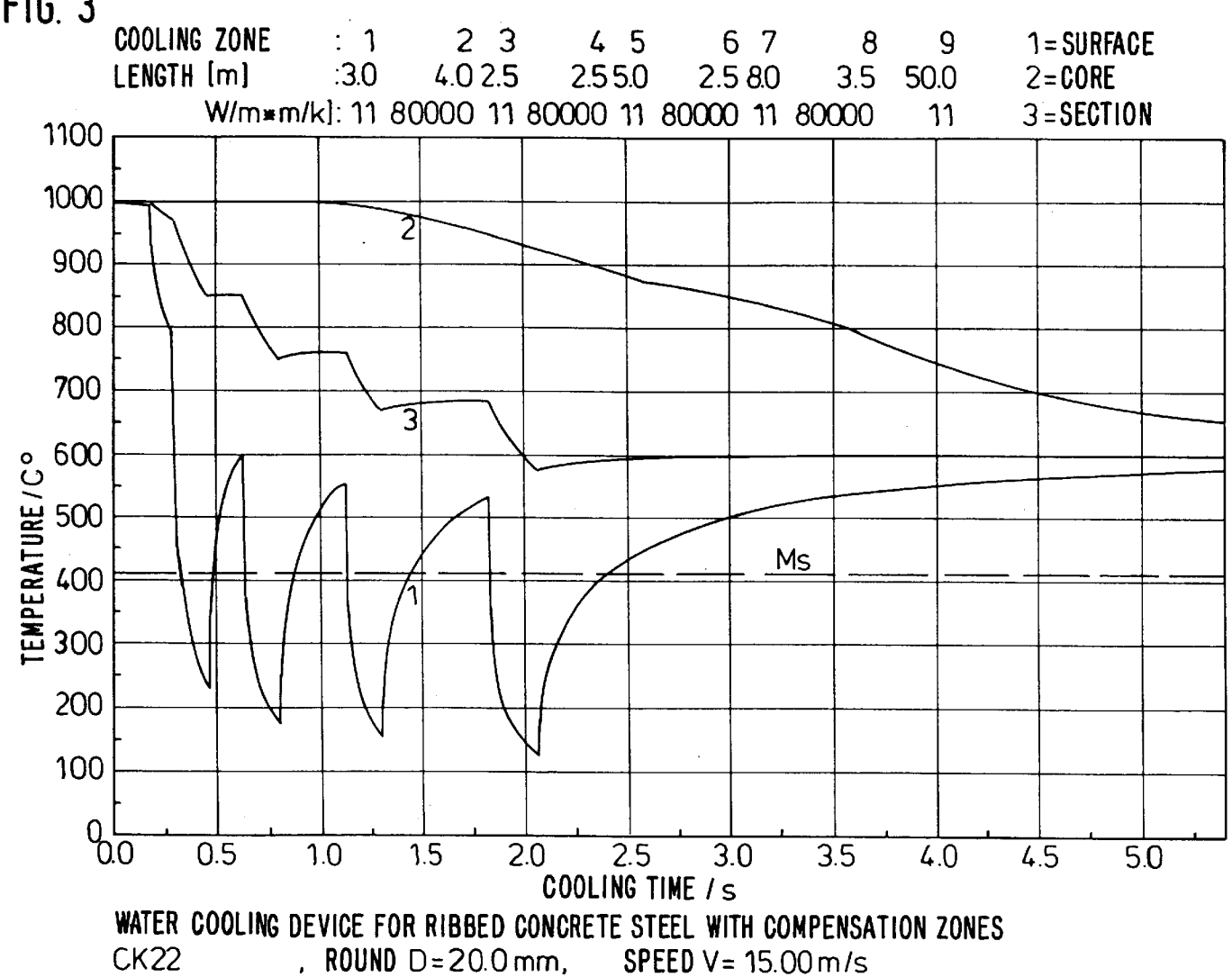
FIG. 3 shows temperature-time-curves of a ribbed concrete steel (having a total diameter of 20 mm) with boundary layers hardened by the method according to the invention.
Figure 4:
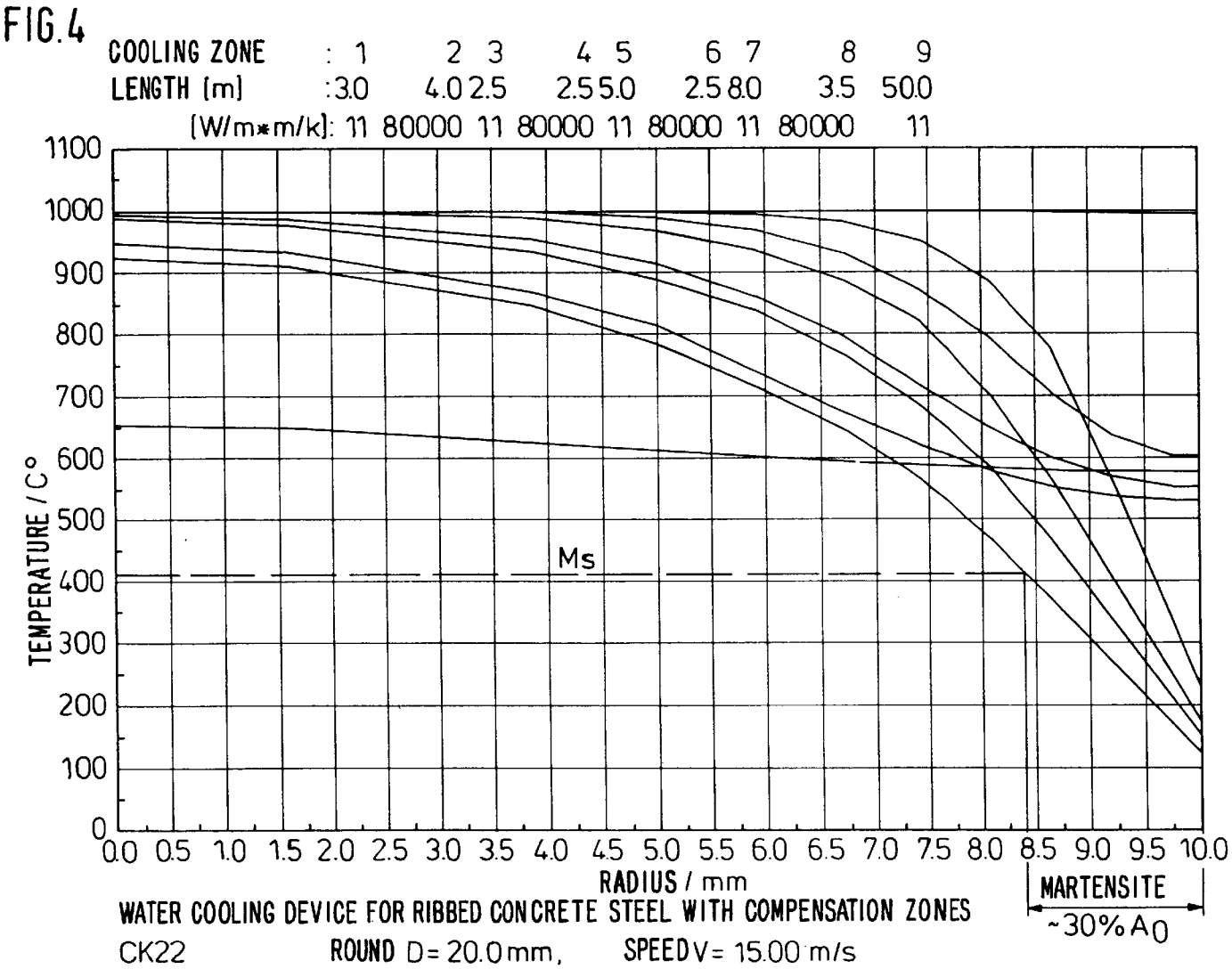
FIG. 4 shows the temperature distribution across the diameter of the ribbed concrete steel according to FIG. 3.

In comparison, FIG. 3 shows the temperature-cooling time curves for the same type of steel but for a smaller diameter of the long product (20 mm). The workpiece is transported with higher speed through the individual cooling zones, for example, with a speed of 15.00 m/s. The individual cooling process steps accordingly occur faster in comparison, but the individual process steps of quenching (cooling phase) to a temperature below the martensite starting temperature as well as the stress-relief phases of the microstructure by self-annealing are still clearly visible. After passing through the nine cooling zones, approximately 30% of the cross-section of the long product has been transformed to martensite (FIG. 4).

Figure 5:
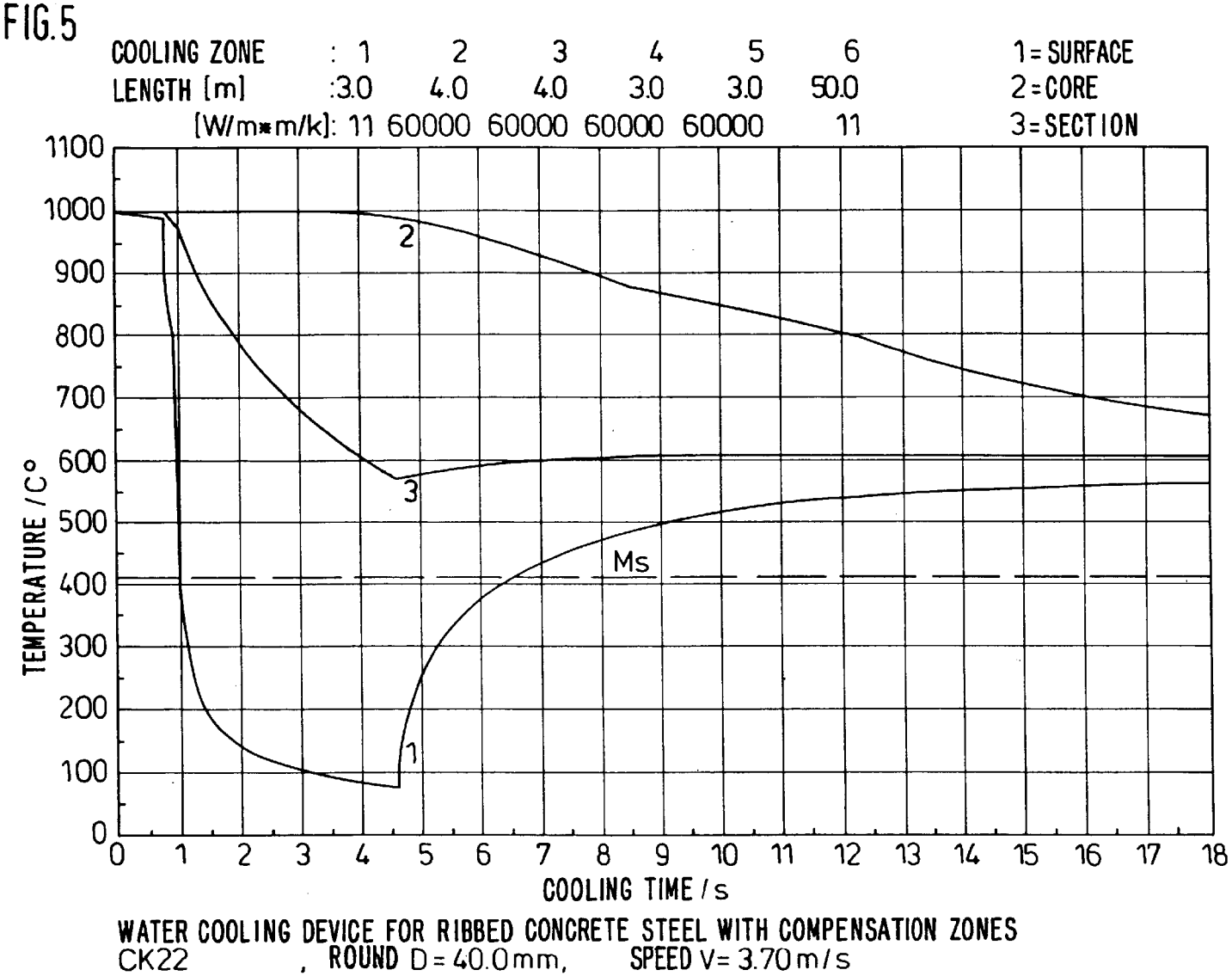
FIG. 5 shows temperature-time-curves of a ribbed concrete steel (having a total diameter of 40 mm) with boundary layers hardened according to the conventional method.
Figure 6:
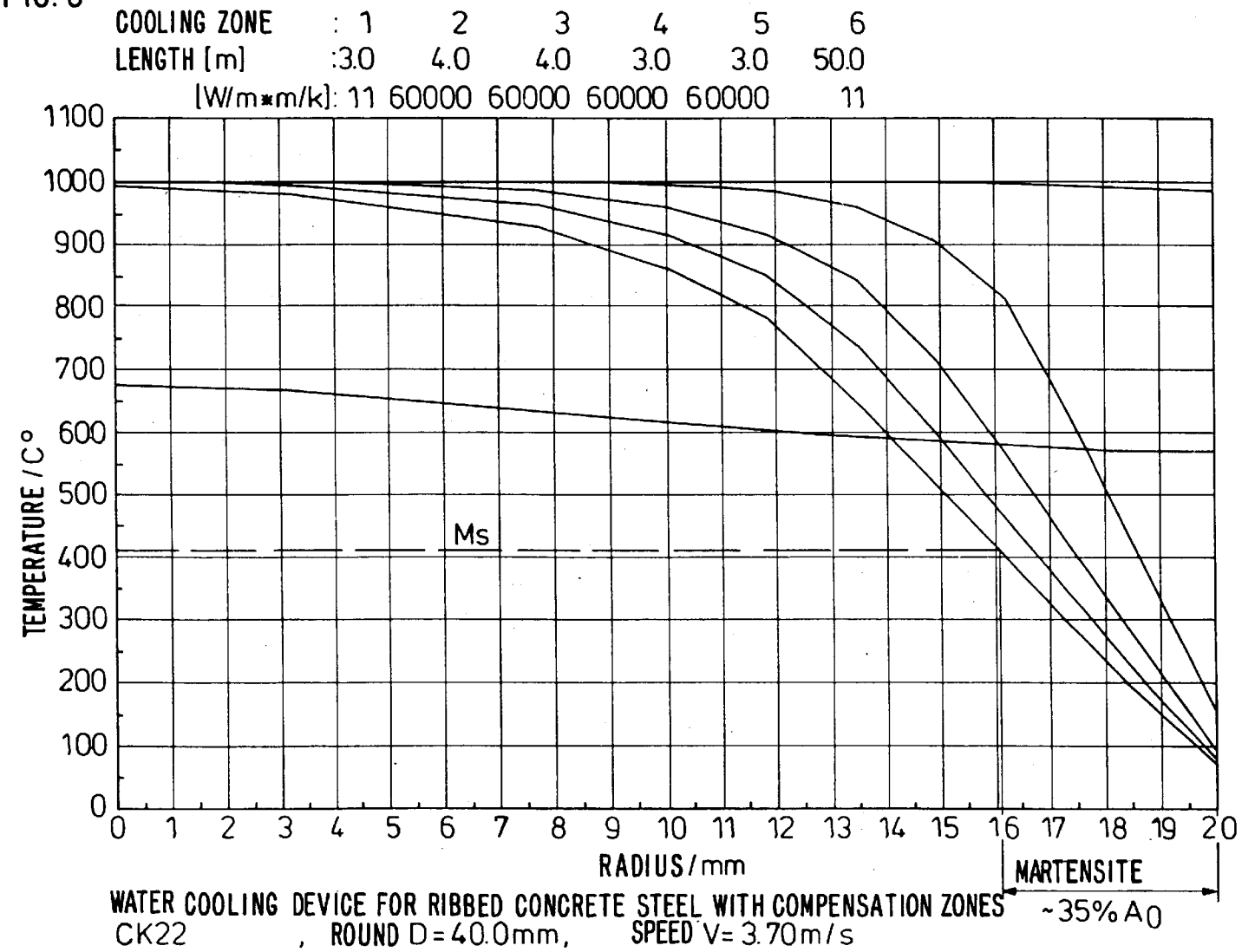
FIG. 6 shows the temperature distribution across the diameter of the ribbed concrete steel according to FIG. 5.
Figure 7:
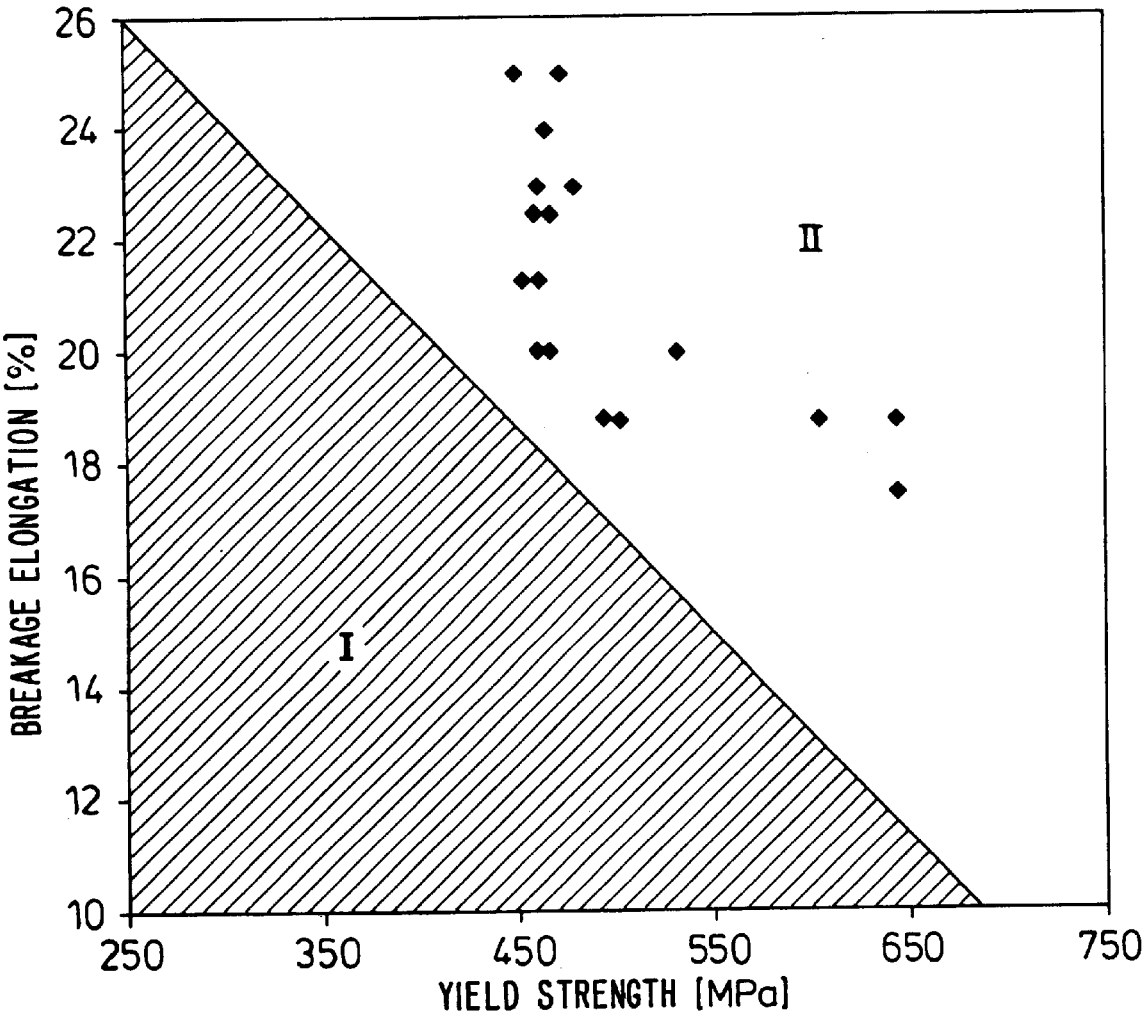
FIG. 7 is a representation of the breakage elongation as a function of the yield strength for an unalloyed construction steel (C≈0.25%, Si≈0.29%, Mn≈1.0%), comparing hardening according to the conventional method (I) and the method according to the invention (II)
Figure 8:
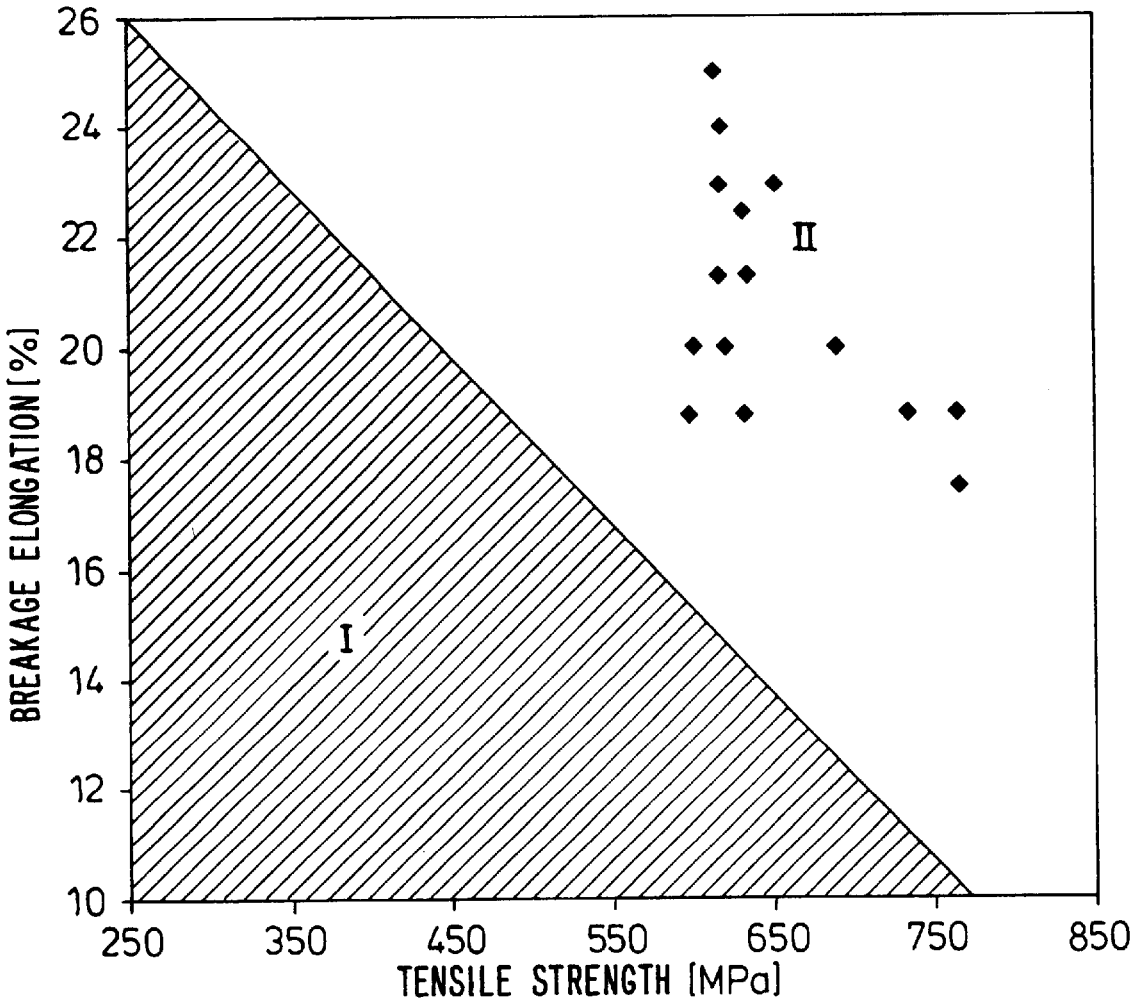
FIG. 8 is a representation of the breakage elongation as a function of the tensile strength for an unalloyed construction steel (C≈0.25%, Si≈0.29%, Mn≈1.0%), comparing hardening according to the conventional method (I) and the method according to the invention (II)
Figure 9:
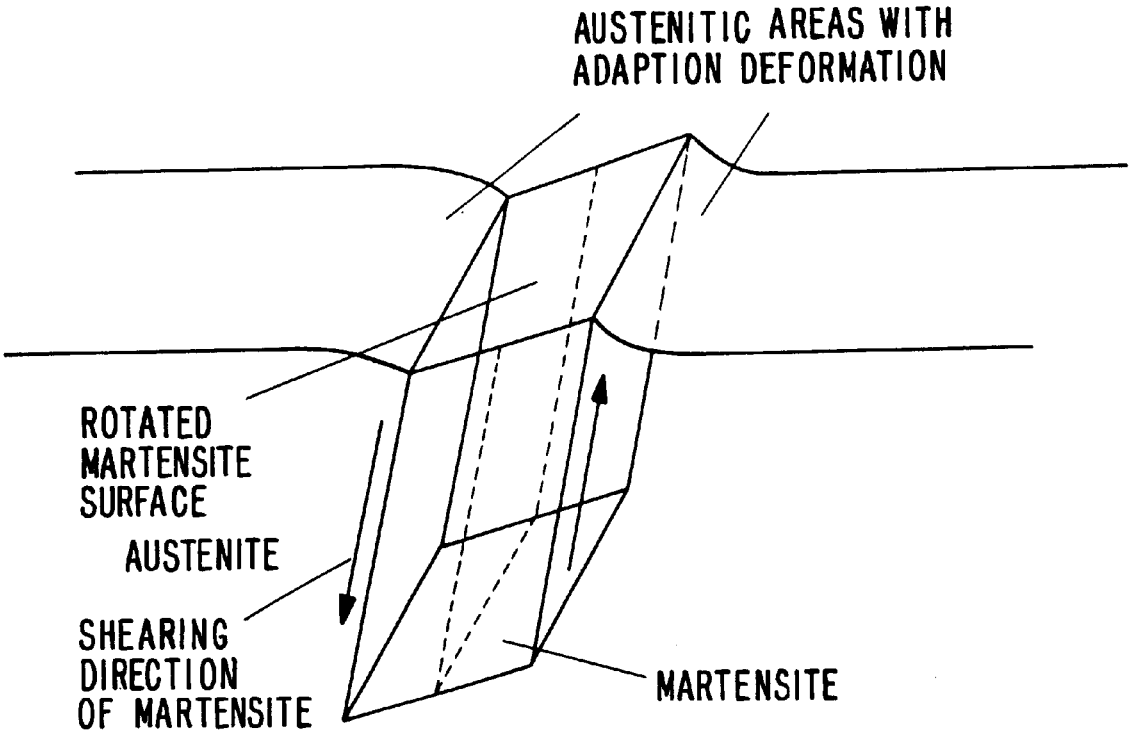
FIG. 9 shows the martensite transformation and the adaptation deformation of the surrounding austenite matrix.

FIGS. 5 and 6 illustrate the differences between the method according to the invention and the known method for the boundary layer hardening of long products. Even though according to the conventional method 35% martensite grain can also be achieved in the boundary layers, the single quenching treatment with subsequent single self-annealing step causes microfissures in the grain (microstructure) and, in turn, reduced tenacity properties, which, however, are improved according to the method of the present invention. FIGS. 7 and 8 illustrate the breakage elongation as a function of the elongation limit, respectively, the tensile strength of an unalloyed construction steel comparing hardening of the boundary layer by the conventional method (I) and the method (II) according to the present invention. These graphs clearly show that the tenacity properties increase while the same strength values are maintained when using the method according to the invention.

The method according to the present invention is in particular useful for boundary layer hardening of concrete steels. They are especially employed as reinforcement steels for manufacturing supports in steel construction.

While specific embodiments of the invention have been shown and described in detail to illustrate the inventive principles, it will be understood that the invention may be embodied otherwise without departing from such principles.

What is claimed is:

1. A heat treatment method for producing boundary layer-hardened long products and flat products of unalloyed or low-alloy steel, the method comprising the steps of:

cooling a workpiece for producing a martensitic grain within a boundary layer of the workpiece by repeating several sequential cooling process steps, wherein each one of the sequential cooling process steps is comprised of a cooling phase, in which the workpiece is cooled to a temperature below a martensite starting temperature for martensitic conversion of only a portion of the boundary layer of the workpiece, and a temporal stress-relief phase for relieving stress within at least one of already formed martensitic grain areas and already formed martensite/austenite boundary areas; and, subsequently, cooling the workpiece at a cooling rate below a lower critical cooling rate for cooling the workpiece core, wherein in each sequential cooling process step during the stress-relief phase the workpiece is heated again to an austenite-forming temperature for partial reconversion of the already formed martensite to austenite.

2. The method according to claim 1, wherein in each sequential cooling process step self-annealing of the martensitic grain areas, formed during the cooling phase of the respective sequential cooling process, is performed during the stress-relief phase as a result of residual heat within an interior of the workpiece.

3. The method according to claim 1, wherein the number of sequential cooling process steps is selected based on a predetermined hardening depth of the boundary layer.

4. The method according to claim 1, performed immediately after a rolling process.

5. The method according to claim 1, performed immediately after an auxiliary heat treatment process.

6. The method according to claim 1, wherein the steel product to be produced is concrete steel.

7. A support made of a steel product produced according to claim 1.

8. A reinforcement made of a steel product produced according to claim 1.

* * * * *